US008538670B2

(12) United States Patent
Lanzl et al.

(10) Patent No.: US 8,538,670 B2
(45) Date of Patent: Sep. 17, 2013

(54) CONSTRUCTION MACHINE HAVING A COMPUTER UNIT FOR DETERMINING AN ADJUSTMENT RANGE

(75) Inventors: Martin Lanzl, Ingolstadt (DE); Josef Haas, Schrobenhausen (DE); Markus Mayr, Ehekirchen (DE); Manfred Angermeier, Karlskron (DE); Thomas Elsner, Schrobenhausen (DE)

(73) Assignee: Bauer Maschinen GmbH (DE)

( * ) Notice: Subject to any disclaimer, the term of this patent is extended or adjusted under 35 U.S.C. 154(b) by 230 days.

(21) Appl. No.: 13/070,637

(22) Filed: Mar. 24, 2011

(65) Prior Publication Data

US 2012/0072081 A1 Mar. 22, 2012

(30) Foreign Application Priority Data

Apr. 16, 2010 (EP) ..... 10004084

(51) Int. Cl.
*G06F 17/10* (2006.01)

(52) U.S. Cl.
USPC ..... 701/124; 340/685; 414/634; 701/50

(58) Field of Classification Search
USPC ..... 701/50, 124; 73/65.01; 340/685; 414/634
See application file for complete search history.

(56) References Cited

U.S. PATENT DOCUMENTS

| | | | | |
|---|---|---|---|---|
| 4,511,974 | A * | 4/1985 | Nakane et al. | 701/124 |
| 4,566,824 | A * | 1/1986 | Minier et al. | 405/202 |
| 5,361,211 | A * | 11/1994 | Lee et al. | 701/50 |
| 5,650,930 | A * | 7/1997 | Hagenbuch | 701/50 |
| 5,742,914 | A * | 4/1998 | Hagenbuch | 701/29.6 |
| 6,240,353 | B1 * | 5/2001 | Ishikawa et al. | 701/50 |
| 6,266,594 | B1 * | 7/2001 | Ishikawa | 701/50 |
| 6,477,099 | B2 | 11/2002 | Fischer et al. | |
| 6,535,807 | B2 * | 3/2003 | Christensen et al. | 701/50 |
| 6,611,746 | B1 * | 8/2003 | Nagai | 701/50 |
| 7,165,643 | B2 * | 1/2007 | Bozem et al. | 180/209 |
| 7,706,947 | B2 * | 4/2010 | Bozem et al. | 701/50 |
| 7,778,756 | B2 * | 8/2010 | Hartwick et al. | 701/50 |
| 7,894,962 | B2 * | 2/2011 | Sahlin et al. | 701/50 |
| 8,160,806 | B2 * | 4/2012 | Salaka | 701/124 |
| 8,204,653 | B2 * | 6/2012 | Sahlin et al. | 701/50 |
| 8,229,631 | B2 * | 7/2012 | Morey et al. | 701/50 |
| 2006/0289205 | A1 | 12/2006 | Law et al. | |

FOREIGN PATENT DOCUMENTS

| | | | |
|---|---|---|---|
| DE | 20011371 | U1 | 9/2000 |
| EP | 0 406 419 | A1 | 1/1991 |
| EP | 1717375 | A1 | 11/2006 |
| JP | 01-138407 | A | 5/1989 |
| JP | H8-326458 | A | 12/1996 |
| RU | 2093452 | C1 | 10/1997 |
| RU | 47865 | U1 | 9/2005 |

OTHER PUBLICATIONS

European Search Report; EP10004084; Sep. 24, 2010. EP Office Action; 10 004084.9.

* cited by examiner

*Primary Examiner* — Helal A Algahaim
(74) *Attorney, Agent, or Firm* — Studebaker & Brackett PC

(57) ABSTRACT

The invention relates to a construction machine having a carrier unit, an actuation unit, which is adjustable with respect to the carrier unit, at least one detecting means for detecting status data of the construction machine, and a computer unit, by means of which, based on the detected status data, at least one adjustment range of the actuation unit can be determined, in which the actuation unit is adjustable at a given safety against tilting of the construction machine. The invention also relates to a method for operating a construction machine of such type.

10 Claims, 1 Drawing Sheet

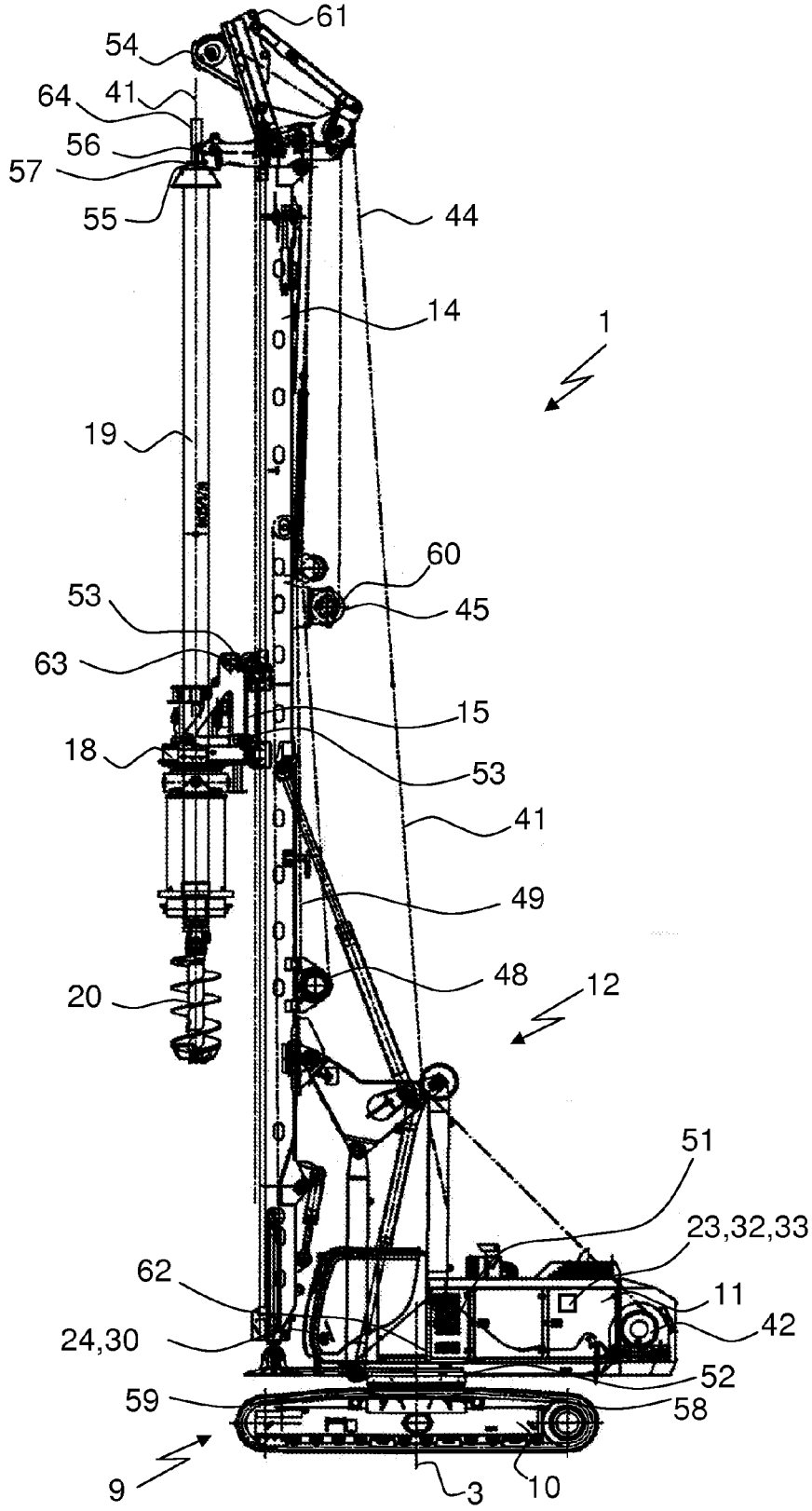
61
54
64
41
56
57
55
44
14
1
19
60
53
45
63
15
18
53
41
49
48
12
20
51
23,32,33
62
11
42
24,30
52
59
58
9
3
10

CONSTRUCTION MACHINE HAVING A COMPUTER UNIT FOR DETERMINING AN ADJUSTMENT RANGE

TECHNICAL FIELD

The invention relates to a construction machine in accordance with claim 1 as well as to a method for operating a construction machine in accordance with claim 10.

BACKGROUND

During operation of large construction machines, as for example earth drilling apparatuses, tilting moments may occur on the construction machines. Such tilting moments can be caused statically, for example by projecting loads, but also dynamically, for example as a result of centrifugal forces.

In order to prevent the occurrence of excessive tilting moments, it is known, among other things, to limit the adjustment paths of projecting loads constructively. However, in many cases this also leads to a restriction of the operating range of the construction machine and therefore to a limitation of the range of application of the construction machine.

The object of the invention is to provide a construction machine which, whilst featuring an especially high operational reliability, in particular with regard to safety against tilting, has an especially large working radius, possesses an especially great versatility of application and an especially high efficiency.

The object is solved by a construction machine having the features of claim 1. Preferred embodiments are stated in the dependent claims. Furthermore, the object is solved by a construction machine having the features of claim 10.

In accordance with the invention a construction machine is provided having a carrier unit, an actuation unit, which is adjustable with respect to the carrier unit, at least one detecting means for detecting status data of the construction machine, and a computer unit, by means of which, based on the detected status data, at least one adjustment range of the actuation unit can be determined, in which the actuation unit is adjustable at a given safety against tilting of the construction machine.

The invention is based on the knowledge that during adjustment of a heavy-weight actuation unit relative to the carrier unit, which supports the actuation unit, shifts of the center of mass may occur that are accompanied by corresponding variable tilting moments. In order to enable a tilt-safe operation despite these variable tilting moments a computer unit is provided in accordance with the invention. This computer unit determines an adjustment range, in which the actuation unit can be moved safely with respect to its carrier unit. The safe adjustment range can be characterized, for example, in that within it a preset tilting-safety factor is observed. To determine the adjustment range e.g. appropriate characteristic curves or charts can be stored in the evaluation unit.

The determination of the adjustment range is effected depending on status data of the construction machine, i.e. by comprehensive consideration the computer unit can take into account that the tilting tendency is not only determined by the projection of the actuation unit but is also influenced by further factors, such as the load present on the actuation unit or the dynamic state of the construction machine. Therefore, the status data can be e.g. data relating to the diameter of a drill pipe held by the actuation unit, with the diameter, in turn, having an effect on the tilting moment via the related mass of the drill pipe.

The construction machine concerned can, in particular, be an earth drilling apparatus. In this case the actuation unit can be e.g. the drill drive for an earth drilling tool and the carrier unit can be the undercarriage of the drilling apparatus.

Is it especially advantageous that by means of the computer unit the position of the actuation unit within the adjustment range can be determined and on reaching a limit of the adjustment range a signal can be emitted. According to this embodiment the computer unit puts the actual position of the actuation unit in relation to the computed adjustment range so that direct evaluation can be made as to whether a tilt-safe operation is given or the danger of tilting is imminent. The signal emitted on reaching the limit of the adjustment range can, for example, be an operator signal, i.e. for instance an acoustic or optical signal that can be perceived by an operator of the construction machine. In particular, as an optical signal a corresponding indication on an operator's display can be provided. This enables the operator to detect the closing-in on a tilt-critical range so that appropriate counter-measures can be taken by the operator. Alternatively or additionally provision can be made for a control signal to be emitted as a signal for the actuation unit. By making use of such control signals the computer unit can keep the actuation unit automatically in the safe adjustment range so that a particularly reliable operation is given.

The invention can be used especially in mobile construction machines because in this case particular attention must often be paid to safety against tilting. Accordingly, it is useful for the carrier unit to have a running gear. In particular, the carrier unit concerned can be an undercarriage of the construction machine.

By preference, provision can be made for the actuation unit to have at least one foundation construction tool, in particular a drilling tool. The actuation unit can be designed, for example, as a rotary drill drive and/or a vibratory drill drive.

For an especially large work range it is of advantage that the actuation unit is pivotable with respect to the carrier unit about a vertical axis and/or is adjustable radially to the vertical axis. The vertical axis can be understood, in particular, as an axis running at least approximately in the vertical direction. In particular, provision can be made for the actuation unit designed as a drill drive to be arranged on a mast that is adjustable radially with respect to an upper carriage, which is in turn pivotable with respect to the carrier unit designed as an undercarriage.

The detecting means according to the invention can detect the status data through physical measurement. It can also be advantageous for at least one detecting means to be provided which detects status data that are entered manually by the operator. For instance provision can be made for the operator to receive a selection menu of possible drill pipe diameters, for example 880 mm or 1300 mm, or for the drill pipe diameter to be detected automatically. According to the input the computer unit then determines adjustment ranges of different sizes, with the adjustment range being always smaller in the case of a larger drill pipe diameter and therefore a heavier drill pipe than in the case of a smaller diameter. If a detecting means for detecting manually entered status data is provided, it is advantageous for the computer unit to have a storage means for storing the manually entered data. In this way, documentation is made available in order to be able to establish in the case of possible defects whether the entered data were correct.

Another preferred embodiment of the invention resides in the fact that a handling assistance switch means is provided that can be actuated by an operator and is in signal connection with the computer unit, whereby the computer unit is adapted to modify the adjustment range depending on a switch state of the handling assistance switch means. This embodiment takes into account that different operating modes frequently occur on the construction machine that require different considerations of safety against tilting. For example in the case of a drilling operation of a drilling apparatus additional forces frequently occur on the drilling tool that can increase the tilting tendency, or an inclined mast is used for operation which can also increase the tilting tendency. Therefore, the computer unit can determine a limited adjustment range during drilling operation. On the other hand, during a handling operation, in which the tool is only moved e.g. for the purpose of emptying a drilling bucket at a place located further away from the drill hole, at least a part of these additional loads is often no longer present so that an extended adjustment range can be provided. The handling assistance switch means can be realized for example through a switch or a touch screen, on which the operator predefines if a work operation, in particular a drilling operation, or a handling operation is provided. For documentation the handling assistance switch means suitably has a storage means that is adapted to store the operator's selection on the handling assistance switch means.

The extension of the adjustment range in the handling mode presupposes that other operating parameters of the construction machine and the tilting moments related thereto are limited. For instance the extended adjustment range in the handling mode can only be justified if the winch pulling forces of a main winch, an auxiliary winch or a feed winch lie below an admissible limit. In order to render it easier for the operator to observe these limits, it can be advantageous if the handling assistance switch means has an indication means that shows the operator the limits of these operating parameters if the handling mode is selected on the handling assistance switch means. For example the admissible winch pulling forces can be shown on a display.

However, it is especially advantageous for a limiting unit to be provided which is adapted to limit at least one operating parameter of the construction machine depending on the switch state of the handling assistance switch means. According to this embodiment the critical operating parameters can be limited automatically if the handling mode is selected on the handling assistance switch means. The at least one operating parameter that is limited and/or indicated to the operator can be winch pulling forces in particular. Accordingly, provision can be made for the limiting unit to reduce the torque of a feed winch and switch off an auxiliary winch if the handling operation is selected.

Furthermore, it is of advantage that the handling assistance switch means comprises a protection means which prohibits the effect of an actuation of the handling assistance switch means, if at least one operating parameter of the construction machine lies outside a given range. According to this embodiment the effect of the actuation of the handling assistance switch means can be prohibited if at least one operating parameter is atypical for the handling operation so that an extension of the adjustment range is not justified.

The at least one operating parameter of the construction machine, whose limits are indicated to the operator, which is limited by means of the limiting unit and/or which is taken into account by the protection means can, in particular, be a rotational speed of the upper carriage and/or an inclination of the mast. In many cases construction machines have an upper carriage which is arranged on the carrier unit by being rotatable about a vertical axis and on which a mast is arranged that supports the actuation unit. If the upper carriage is rotated together with the actuation unit relative to the carrier unit about the vertical axis, centrifugal forces can occur that lead to a dynamic increase of the tilting tendency. Therefore, a manual or automatic limitation of the rotational speed of the upper carriage can be of advantage. Moreover, the inclination of the mast relative to the upper carriage can also have an effect on the tilting tendency so that a limitation of the mast inclination can equally be advantageous with regard to safety against tilting.

The at least one operating parameter, whose limits are indicated, which is limited by means of the limiting unit and/or which is taken into account by the protection means can also be an angle of rotation of the upper carriage relative to the undercarriage because in many cases a mobile undercarriage does not have the same tilting safety in all spatial directions.

The status data, on the basis of which the adjustment range is determined by the computer unit, can be a weight force on the actuation unit in particular. For example the pipe length on the actuation unit can be taken into account, for the longer the drill pipe suspended on the actuation unit the greater the tilting tendency in many cases.

Furthermore, it is of advantage that at least one detecting means for detecting a position of a mast supporting boom is provided. The position of the mast supporting boom that connects the mast with the upper carriage very often constitutes a measure for the radial position of the mast and therefore the position of the actuation unit relative to the upper carriage, for which reason it also determines the tilting moment.

In addition, it is preferred that at least one detecting means for detecting an angle of rotation of the upper carriage is provided. For the carrier unit often does not have the same tilting stability in all spatial directions. Consequently, the angle of rotation of the upper carriage relative to the carrier unit, in particular about a vertical axis, is also an indicator as to safety against tilting.

Moreover, it is suitable that at least one detecting means for detecting a pull and/or push force in a feed system for a sledge is provided. A sledge feed system can be understood, in particular, as a system that displaces the actuation unit relative to the mast in the vertical direction. The pull and/or push force acting there can also have an effect on the tilting moment.

Furthermore, it is advantageous for at least one detecting means to be provided for detecting a pull force in a main rope. A corresponding main rope can support a drill rod running on the actuation unit. Thus, the pull force of the main rope can also determine the tilting moment.

In addition, it is useful for at least one detecting means to be provided for detecting a pull force in an auxiliary rope. For such an auxiliary rope, which can be employed during the installation of a drill rod for example, can also give rise to tilting moments.

Another embodiment resides in the fact that at least one detecting means for detecting at least one run-in angle of the auxiliary rope is provided, since the run-in angle can also have an effect on the tilting moment caused by the auxiliary rope. For best suitability, the run-in angle is determined in two spatial planes.

Another preferred embodiment of the invention resides in the fact that at least one detecting means for detecting at least one angle of inclination of the carrier unit is provided. For best suitability, the angle of inclination is determined in two spatial planes. The angle of inclination of the undercarriage can also have a bearing on the tilting moments.

Moreover, it is preferred that at least one detecting means for detecting at least one angle of inclination of the mast is provided. The angle of inclination of the mast can be understood, in particular, as the angle of inclination of the mast relative to the upper carriage. Likewise, this angle can also influence the tilting moments. For best suitability, the angle of inclination is determined in two spatial planes.

Furthermore, it is advantageous that at least one detecting means for detecting a rope-end position of the auxiliary rope is provided. In this way consideration can be given to the fact that the load fixed on the auxiliary rope may be subject to oscillating movements that also contribute to the tilting moment. The detecting means for detecting a rope-end position of the auxiliary rope can be designed, in particular, as a detecting means for detecting the wind-off angle of a drum for the auxiliary rope.

In addition, it is useful that at least one detecting means for detecting a wind speed is provided. In this way, the fact is taken into account that wind loads can also have an increasing effect on the tilting moment.

Furthermore, in accordance with the invention, it can be that at least one detecting means for detecting a rotational speed of the upper carriage is provided. A rotation of the upper carriage relative to the carrier implement about the vertical axis is accompanied by corresponding centrifugal forces that can also have an increasing effect on the tilting moment. Against this background the detection of the rotational speed of the upper carriage relative to the carrier implement proves to be useful.

Moreover, it is advantageous that at least one detecting means for detecting a rope-end position of a feed rope is provided. The position of the feed rope provides an indication as to the position of the actuation means and therefore the position of the center of mass relevant for safety against tilting.

In addition, it is preferred that at least one detecting means for detecting a rope-end position of the main rope is provided. By detecting the end position of the main rope coordinates of the center of mass can be determined that determine the tilting moment.

Accordingly, it is of advantage that the status data relate to the position of the mast supporting boom, the angle of rotation of the upper carriage, the pull and/or push force in the feed system for the sledge, the pull force in the main rope, the pull force in the auxiliary rope, the at least one run-in angle of the auxiliary rope, the at least one angle of inclination of the carrier unit, the at least one angle of inclination of the mast, the rope-end position of the auxiliary rope, the wind speed, the rotational speed of the upper carriage, the rope-end position of the feed rope and/or the rope-end position of the main rope.

Another preferred embodiment of the invention resides in the fact that an indication means is provided, with which the adjustment range can be indicated together with the current position of the actuation unit and in that the indication means is adapted to represent the adjustment range as well as the current position in one common sketch-map. In particular, provision can be made for the indication means to be adapted to represent the adjustment range through colored highlighting. According to this embodiment the safe adjustment range and the actual current position of the actuation unit in relation to this adjustment range are indicated visually to the operator. As a result, the situation of tilting safety is indicated in a manner intuitively comprehensible to the operator.

The invention also relates to a method for operating a construction machine, in particular a construction machine according to the invention, having a carrier unit, an actuation unit, which is adjustable with respect to the carrier unit, at least one detecting means for detecting status data of the construction machine, and a computer unit, in which case provision is made that based on the detected status data at least one adjustment range of the actuation unit is determined by the computer unit, in which the actuation unit can be adjusted at a given safety against tilting of the construction machine. The embodiments described in connection with the construction machine according to the invention can also be used in connection with the method according to the invention, whereby the advantages set out in conjunction with the construction machine can be achieved.

BRIEF DESCRIPTION OF THE DRAWINGS

In the following the invention will be explained in greater detail by way of preferred embodiments shown schematically in the accompanying FIGURE, wherein:

FIG. 1 shows a side view of a construction machine according to the invention.

DETAILED DESCRIPTION

A construction machine in accordance with the invention is shown in FIG. 1. The construction machine 1 is designed as a mobile earth drilling apparatus. It has a carrier unit 10 designed as an undercarriage and having a running gear 9 designed as a crawler-type running gear. On this carrier unit 10 an upper carriage 11 of the construction machine 1 is arranged. The upper carriage 11 is provided on the carrier unit 10 by being pivotable about the vertical axis 3.

On the upper carriage 11 mast supporting booms 12 are arranged that support a mast 14 and connect it to the upper carriage 11. The mast supporting booms 12 are provided in a pivotable manner about horizontally running axes. By pivoting the mast supporting booms 12 the mast 14 can be adjusted radially with respect to the upper carriage 11 and therefore the carrier unit 10. On the mast 14, in turn, a sledge 15 is arranged in a vertically displaceable manner. On this sledge 15 an actuation unit 18 is provided that constitutes a rotary drill drive. The actuation unit 18 has a driven foundation construction tool 19, 20, which is formed by a drill rod 19 with an auger 20 arranged on the underside. The drill rod 19 can be designed as a Kelly bar in particular.

By pivoting the upper carriage 11 relative to the carrier unit 10 the actuation unit 18 can also be pivoted with respect to the carrier unit 10 about the vertical axis 3. By pivoting the mast supporting booms 12 the actuation unit 18 can be pivoted radially to the carrier unit 10 in relation to the vertical axis 3.

The drill rod 19 of the foundation construction tool is suspended on a main rope 41 that runs around the head of the mast 14. For actuation of the main rope 41 a main rope winch 42 is provided in the rear part of the upper carriage 11 or on the mast 14. Furthermore, around the mast 14 an auxiliary rope 44 is guided that can be actuated by means of an auxiliary rope winch 45. This auxiliary rope 44 can be employed, for example, if the drill rod 19 is installed on the construction machine 1. For vertical displacement of the sledge 15 on the mast 14 a feed system with a feed winch 48 and a feed rope 49 that runs around the mast 14 and is fixed on the sledge 15 is provided.

On the construction machine 1 a computer unit 23 is provided that is in signal connection with a number of detecting means 51 to 64 described in greater detail below. On the basis of the status data detected by the detecting means 51 to 64 an adjustment range of the actuation unit 18 can be determined by the computer unit 23, in which the actuation unit 18 can be adjusted in a tilt-safe manner, in particular being displaceable radially to the vertical axis 3 and/or pivotable about the vertical axis 3. In the operator's cabin of the upper carriage 11 an indication means 24 is provided for this purpose, which is in signal connection with the computer unit 23 and with which the adjustment range can be indicated together with the actual current position of the actuation unit 18. To this end the indication means 24 can have a display for example.

On the indication means 24 a handling assistance switch means 30 is also arranged that can be realized by a touch screen for example. By means of this handling assistance switch means 30 the operator can enter if a drilling operation or a handling operation is provided. The handling assistance switch means 30 is in signal connection with the computer unit 23, thus making it possible for the computer unit 23 to vary the tilt-safe adjustment range according to the operating mode.

On the construction machine 1 a limiting unit 32 is furthermore provided, which is in signal connection with the computer unit 23 and limits at least one operating parameter of the construction machine 1 depending on the switch state of the handling assistance switch means 30. For instance the limiting unit 32 can limit the pivoting speed of the upper carriage 11 about the vertical axis 3 relative to the carrier unit 10, i.e. to the undercarriage, if the handling mode is selected and in the drilling mode this limitation can be canceled. Alternatively or additionally, the limiting unit 32 can also limit the radial position of the actuation unit 18 by limiting the displacement of the mast supporting booms 12.

Furthermore, on the construction machine 1 a protection means 33 is provided, which is in signal connection with the handling assistance switch means 30 and/or the indication means 24 and prohibits a selection of the handling mode if, for example, the inclination of the mast is too large for this purpose.

As already indicated before, the construction machine 1 has a number of detecting means 51 to 64 which are in signal connection with the computer unit 23 and the data of which are used by the computer unit 23 to determine the adjustment range. In particular, a first detecting means 51 for detecting a position of one of the mast supporting booms 12 is provided. The detecting means 51 can be designed, for example, as a rotary encoder between mast supporting boom 12 and upper carriage 11, which is arranged on the vertical pivot axis of the rear mast supporting boom 12.

A further detecting means 52 for detecting an angle of rotation of the upper carriage 11 relative to the carrier unit 10 is provided. By means of this detecting means 52 the angle of rotation about the vertical axis 3 is determined, about which the upper carriage 11 is rotated relative to the carrier unit 10.

Two further detecting means 53 for detecting a pull and/or push force in the feed system for the sledge 15 are provided. In the illustrated embodiment these detecting means 53 are formed by two force measuring bolts located in the deflection rollers of the feed rope 49. In the case of cylinder feed apparatuses these detecting means can be constituted by pressure detecting means that measure the pull and/or push force of the feed cylinder.

A further detecting means 54 for detecting a pull force in the main rope 41 is provided. This detecting means 54 is formed by a force measuring bolt disposed in an upper deflection roller of the main rope 41.

Another detecting means 55 for detecting a pull force in the auxiliary rope 44 is provided. This detecting means 55 is formed by a force measuring bolt located in an upper deflection roller of the auxiliary rope 44.

Furthermore, two detecting means 56 and 57 for detecting run-in angles of the auxiliary rope 44 on the mast 14 are provided. The first detecting means 56 determines the inclined pulling angle of the auxiliary rope 44 longitudinally to the upper carriage 11 and the second detecting means 57 determines the inclined pulling angle of the auxiliary rope 44 transversely to the upper carriage 11. Both detecting means 56, 57 are each formed by an angle detecting means on the rope run-in point into the upper rope guide of the auxiliary rope 44.

On the carrier unit 10, designed as undercarriage, of the construction machine 1, a further detecting means 58 is furthermore provided for detecting at least one angle of inclination of the carrier unit 10. This detecting means 58 can have two inclination sensors for measuring the inclination longitudinally or transversely to the carrier unit 10.

Another detecting means 59 for detecting the inclination of the mast 14 is provided. This detecting means 59 has two sensors for an angle of inclination longitudinally or transversely to the upper carriage 11.

A further detecting means 60 for detecting a rope-end position of the auxiliary rope 44 is provided. This detecting means 60 is designed as a rotary encoder arranged on the drum of the auxiliary rope winch 45. The detecting means detects the wound-off rope length. In doing so, the position of the load fixed on the auxiliary rope 44 can be determined which can be taken into account, in particular, if the load oscillates after rotation of the upper carriage 11 which can give rise to tilting moments.

A further detecting means 61 for detecting a wind speed is provided. This detecting means 61 is formed by a wind gauge located at the tip of the mast 14.

Another detecting means 62 for detecting the rotational speed of the upper carriage 11 relative to the carrier unit 10 about the vertical axis 3 is provided. This detecting means 62 can be arranged on the upper carriage 11 in particular.

Moreover, a detecting means 63 for detecting a rope-end position of the feed rope 49 of the feed system is provided. In particular, this detecting means 63 can be designed for measuring the position of the actuation unit 18 designed as a rotary drive. From the data of the detecting means 63 coordinates of the center of mass of the pieces of equipment can be determined.

In addition, a further detecting means 64 for detecting a rope-end position of the main rope 41 is provided. More particularly, this detecting means 64 can be designed for measuring the position of a string of the main rope 41. From the rope-end position of the main rope 41, taking the rope-end position of the feed rope 49 into consideration, the coordinates of the center of mass of the foundation construction tool 19, 20 can be established.

The invention claimed is:

1. A construction machine having comprising:

a carrier unit, an upper carriage rotatably mounted on the carrier unit, a mast-supporting boom mounted on the upper carriage, a mast supported by the mast-supporting boom and the upper carriage, an actuation unit adjustably supported by the mast and configured to be adjustable with respect to the carrier unit, a plurality of detectors to detect status data of the construction machine, wherein the plurality of detectors to detect status data include:

a detector configured to detect a position of the mast-supporting boom, a detector configured to detect an angle of rotation of an upper carriage, and a detector configured to detect a pull force in an auxiliary rope, and a computer unit configured to utilize the detected status data to determine at least one adjustment range of the actuation unit and to control the actuation unit to prevent tilting of the construction machine.

2. The construction machine according to claim 1, wherein the computer unit is further configured to determine whether or not the position of the actuation unit is within the adjustment range and to provide a control signal to the actuation unit when the actuation unit is reaching a limit of the adjustment range so as to maintain stability of the construction machine.

3. The construction machine according to claim 1, wherein the carrier unit includes a running gear, the actuation unit includes at least one foundation construction tool, in particular a drilling tool, and the actuation unit is pivotable with respect to the carrier unit about a vertical axis and is adjustable radially to the vertical axis.

4. The construction machine according to claim 1, further comprising:

at least one detector configured to detect status data that are entered manually by an operator.

5. The construction machine according to claim 1, further comprising:

a handling assistance switch connected to the computer unit, the handling assistance switch is configured to be actuated by an operator to modify the adjustment range depending on a switch state of the handling assistance switch.

6. The construction machine according to claim 5, further comprising:

a limiting unit adapted to limit at least one operating parameter of the construction machine depending on the switch state of the handling assistance switch.

7. The construction machine according to claim 5, wherein the handling assistance switch includes a protection module configured to prohibit an actuation of the handling assistance switch when at least one operating parameter of the construction machine lies outside a given range.

8. The construction machine according to claim 1, further comprising at least one of the following detectors:

a detector configured to detect a pull and/or push force in a feed system for a sledge, a detector configured to detect a pull force in a main rope, a detector configured to detect at least one run-in angle of the auxiliary rope, a detector configured to detect at least one angle of inclination of the carrier unit, a detector configured to detect at least one angle of inclination of the mast, a detector configured to detect a rope-end position of the auxiliary rope, a detector configured to detect wind speed, a detector configured to detect a rotational speed of the upper carriage, a detector configured to detect a rope-end position of a feed rope, and a detector configured to detect a rope-end position of a main rope.

9. The construction machine according to claim 1, wherein an indicator configured to indicate the adjustment range and the current position of the actuation unit, and the indicator is adapted to represent the adjustment range as well as the current position in one common sketch-map.

10. A method for operating a construction machine comprising:

providing a carrier unit, providing an upper carriage rotatably mounted on the carrier unit, providing a mast-supporting boom mounted on the upper carriage, providing a mast supported by the mast-supporting boom and the upper carriage, providing an actuation unit configured to be adjustable with respect to the carrier unit, providing a plurality of detectors to detect status data of the construction machine, wherein status data includes:

a position of the mast-supporting boom, an angle of rotation of an upper carriage, and a pull force in an auxiliary rope, and providing a computer unit configured to utilize the detected status data to determine at least one adjustment range, based on the detected status data, and controlling the actuation unit to prevent tilting of the construction machine.

* * * * *